US007458107B2

(12) United States Patent
Desjardins et al.

(10) Patent No.: US 7,458,107 B2
(45) Date of Patent: Dec. 2, 2008

(54) ATHLETIC GLOVE WITH WRIST PROTECTION

(76) Inventors: André Desjardins, 311 Parkwood Circle, Dorval, Quebec (CA) H9S 3A4; Bastien Jourde, 4254 rue Leval, Montreal, Quebec (CA) H2W 2J5; Martin Laberge, 5411 rue Chabot, Montreal, Quebec (CA) H2H 1Z1

( * ) Notice: Subject to any disclaimer, the term of this patent is extended or adjusted under 35 U.S.C. 154(b) by 17 days.

(21) Appl. No.: 11/603,838

(22) Filed: Nov. 24, 2006

(65) Prior Publication Data

US 2008/0120753 A1 May 29, 2008

(51) Int. Cl.
*A41D 19/00* (2006.01)

(52) U.S. Cl. ..... 2/161.1; 2/162

(58) Field of Classification Search ..... None
See application file for complete search history.

(56) References Cited

U.S. PATENT DOCUMENTS 5,488,739 A 2/1996 Cardinal
5,511,243 A * 4/1996 Hall et al. ..... 2/16
5,781,929 A * 7/1998 Shikatani ..... 2/16
5,983,396 A 11/1999 Morrow et al.
6,085,354 A * 7/2000 Wilder et al. ..... 2/161.1
6,543,057 B2 * 4/2003 Beland et al. ..... 2/161.1
6,813,780 B2 11/2004 Morrow
6,813,781 B2 11/2004 Wilder et al.
7,117,540 B2 * 10/2006 Morrow ..... 2/161.1
7,313,830 B2 * 1/2008 Desjardins et al. ..... 2/161.1
2005/0114984 A1 6/2005 Marrow et al.

* cited by examiner

*Primary Examiner*—Katherine Moran
(74) *Attorney, Agent, or Firm*—Ogilvy Renault LLP

(57) ABSTRACT

An athletic glove having a hand-receiving portion and a cuff extending therefrom, the cuff including at least an inner cuff member hingedly connected to the hand-receiving portion along a palm side thereof, an outer cuff member hingedly connected to the hand-receiving portion opposite of the inner cuff member so as to define two opposed circumferential gaps therebetween, and at least one connection member extending across each of the circumferential gaps to interconnect the inner and outer cuff members.

17 Claims, 3 Drawing Sheets

ATHLETIC GLOVE WITH WRIST PROTECTION

FIELD OF THE INVENTION

The present invention relates generally to a protective athletic glove, and more particularly to a protective athletic glove having improved wrist protection.

BACKGROUND ART

Risk of injuries is always of concern for athletes, particularly for athletes competing in contact and/or physical sports in which protective clothing is recommended or required, such as for example sporting activities including ice hockey, lacrosse, cricket, field hockey and the like. Particularly for such stick based sports, players usually wear protective gloves such as to limit potential damage to their hands and wrists which may be caused by impacts directed thereagainst by the puck, ball or other players' sticks, as the case may be.

Such protective athletic gloves must offer protection to the wearer's hands and wrists, while nevertheless permitting the wearer good flexibility and range of motion. In particular, lacrosse necessitates a substantial range of motion of the wrists for precise manipulation of the stick, and as such flexibility of the gloves around the wrist joints must be maximal. Accordingly, typical lacrosse gloves usually include wrist cuffs which leave a circumferential gap at the inner wrist such that the player may freely flex his/her wrist, leaving this area unprotected and as such susceptible to injury.

Other gloves include unitary cuffs surrounding the wrist to protect all areas thereof, at the detriment of substantial interference with the wrist's flexing motion.

Accordingly, improvements are desirable.

SUMMARY OF INVENTION

It is therefore an aim of the present invention to provide an improved athletic glove.

Therefore, in accordance with the present invention, there is provided an athletic glove comprising a hand-receiving portion and a cuff extending therefrom, the cuff including at least an inner cuff member hingedly connected to the hand-receiving portion along a palm side thereof, an outer cuff member hingedly connected to the hand-receiving portion opposite of the inner cuff member so as to define two opposed circumferential gaps therebetween, and at least one connection member extending across each of the circumferential gaps to interconnect the inner and outer cuff members.

Also in accordance with the present invention, there is provided an athletic glove comprising a hand-receiving portion for containing a hand of a wearer and a cuff extending from the hand-receiving portion to protect a wrist of the wearer, the cuff including an inner cuff member hingedly connected to the hand-receiving portion along a palm side thereof, an outer cuff member hingedly connected to the hand-receiving portion opposite and spaced apart from the inner cuff member, and two opposed side cuff members extending from the hand-receiving portion and partially overlapping the inner and outer cuff members.

Further in accordance with the present invention, there is provided a method of manufacturing an athletic glove comprising providing a hand-receiving portion defining an opening for inserting a hand therein, hingedly attaching an inner cuff member to the hand-receiving portion around the opening thereof and adjacent a palm portion thereof, hingedly attaching an outer cuff member to the hand-receiving portion around the opening thereof and opposite of the inner cuff member, and interconnecting adjacent sides of the inner and outer cuff members at a location spaced apart from the hand-receiving portion.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
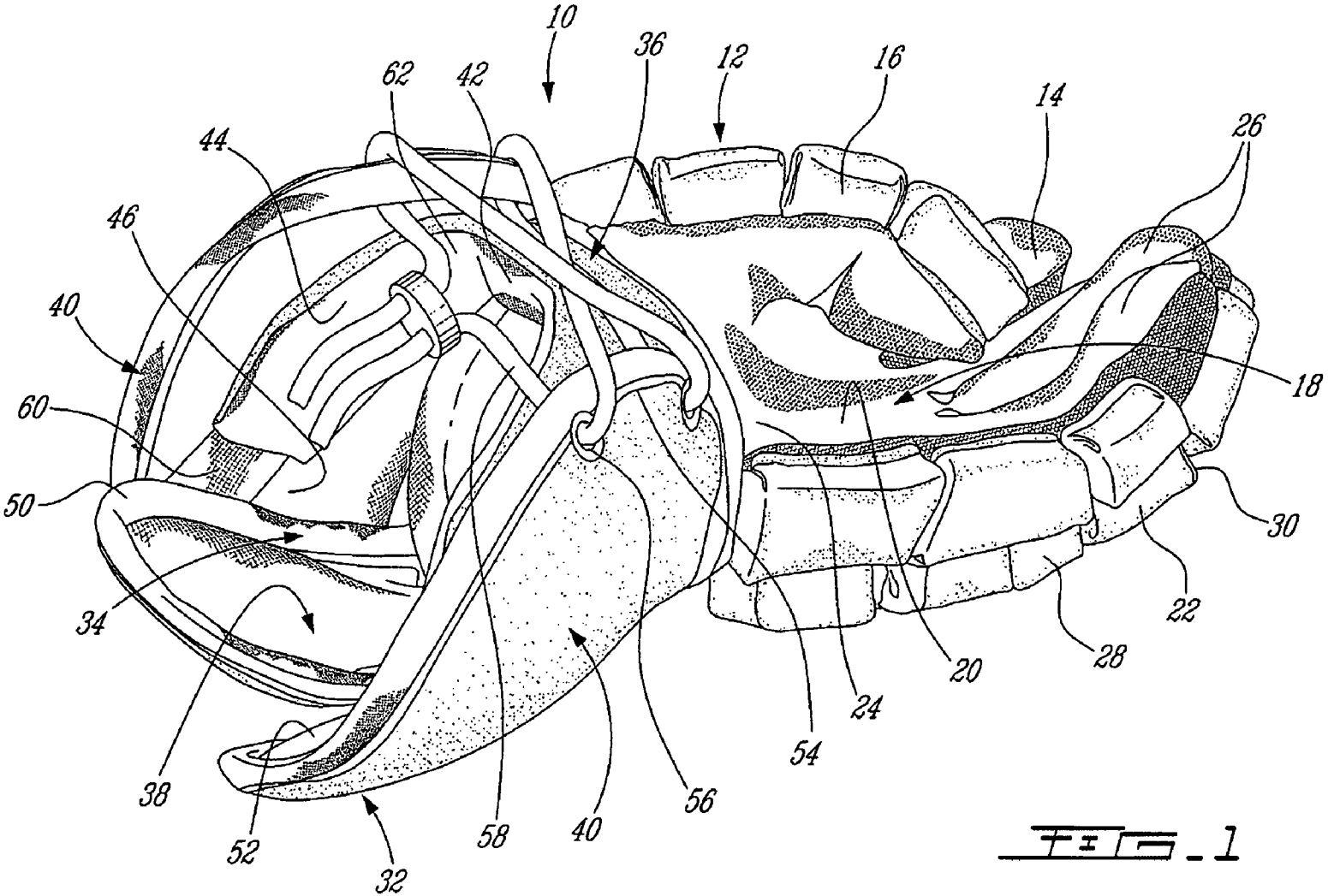
FIG. 1 is a perspective view of an athletic glove according to a particular embodiment of the present invention.

Referring to FIG. 1, a protective lacrosse glove 10 generally comprises a hand-receiving portion 12 adapted to receive a hand of a wearer. In the embodiment shown, the hand-receiving portion 12 includes four finger portions 14 and a thumb portion 16 which extend from a main glove body 18. The main glove body 18 includes an inner palm side 20 generally covering the palm of the wearer's hand, and an opposed padded outer dorsal side 22 generally covering the back side of the wearer's hand. In alternate embodiments which are not shown, the glove 10 can have less than four finger portions 14 with at least one of the finger portions 14 receiving more than one finger therein.

Although the protective athletic glove 10 as depicted and described in further detail below is particularly intended for use as a lacrosse glove, it is to be understood that the protective athletic glove 10 of the present invention can be used for other types of athletic activities during which protection of the hands is desired, such as for example in other contact stick sports like ice and roller hockey or for operating motorized vehicles such as motorcycles, snowmobiles and the like.

The inner palm side 20 of the glove 10 includes a main palm portion 24 which in a particular embodiment is composed of a relatively robust and durable material such as natural leather or a synthetic version thereof. As the wearer regularly grasps a stick (such as a lacrosse stick for example) when wearing the protective athletic glove 10, this main palm portion 24 therefore should provide a good grip on the stick's shaft or handle while being relatively resistant to wear which can occur from frequent sliding of the glove 10 down the stick or rotation of the stick within the wearer's gloved hands. Finger palm portions 26 are integral with and extend from the central main palm portion 24, and therefore, are formed of the same durable material as described above. However, it is to be understood that the finger palm portions 26 could in fact be separate from the main palm portion 24.

The palm portions 24, 26 can also include ventilation openings (not shown), which are preferably covered by any type of appropriate material such as, for example, mesh material.

The outer dorsal side 22 of the hand-receiving portion 12 includes a plurality of pads 28 extending from the main glove body 18, the finger portions 14 and the thumb portion 16. In a particular embodiment, each pad 28 is attached to the hand-receiving portion 12 in a separate envelope. Break lines 30 defined between adjacent envelopes in the finger and thumb portions 14, 16 are provided generally over the joints of the fingers and thumb such as to maximize flexibility of the glove 10.

Figure 2:
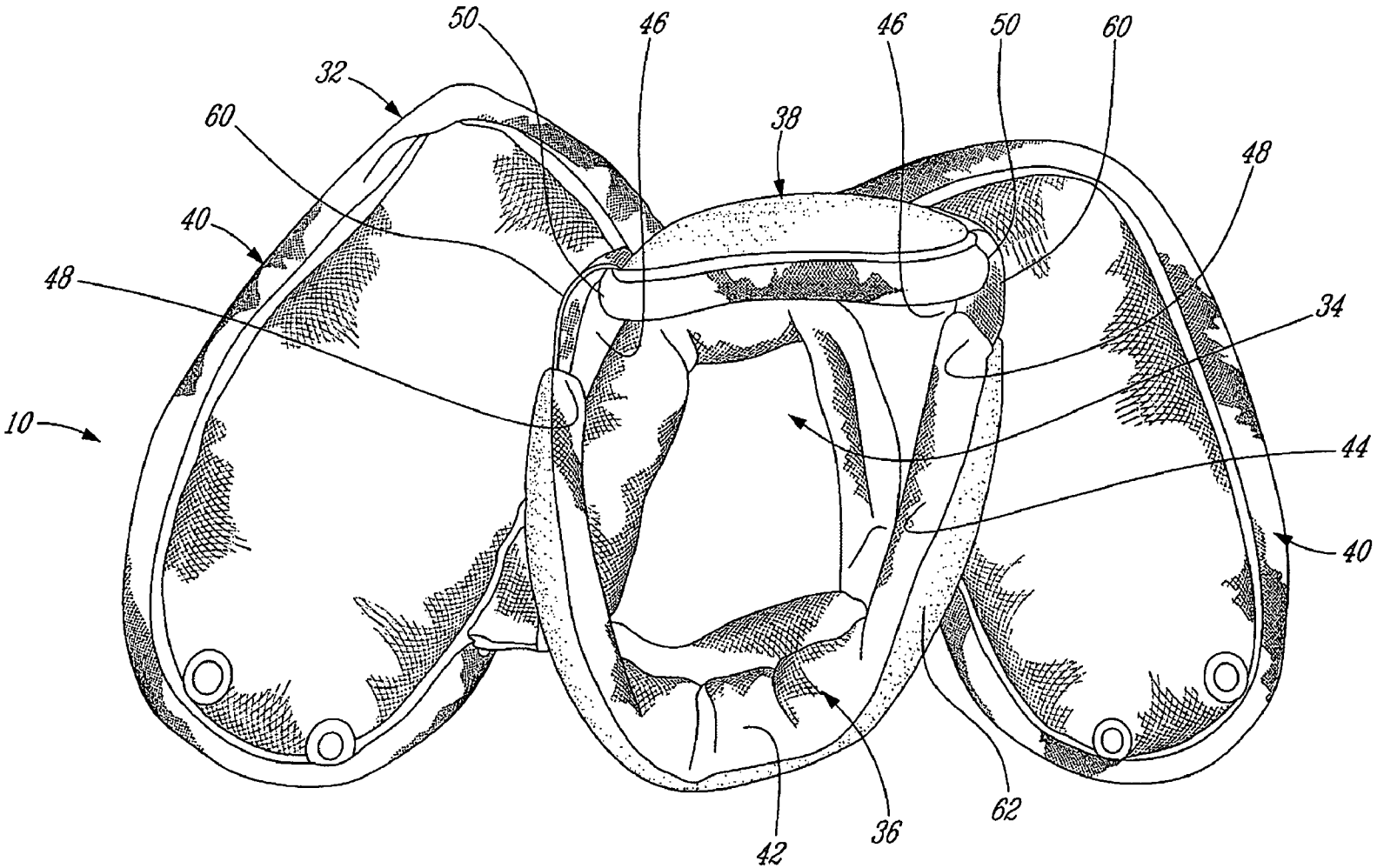
FIG. 2 is an end elevation view of the athletic glove of FIG. 1.

Referring to FIGS. 1-2 the glove 10 also includes a proximal cuff 32 which at least partially circumscribes an opening 34 of the hand-receiving portion 12 within which the user's hand is inserted for putting on the glove 10. In the embodiment shown in FIGS. 1-2, the cuff 32 includes an inner cuff member 36, an outer cuff member 38 and two side cuff members 40.

The inner cuff member 36 is hingedly connected to the hand-receiving portion 12 around the opening 34 thereof, adjacent the palm side 20. In a particular embodiment, the inner cuff member 36 is connected to the hand-receiving portion 12 through at least one stitch line. The inner cuff member 36 includes a base portion 42 connected to the hand-receiving portion 12 and extending therefrom, and opposed side portions 44 extending from the base portion 42 to form a "T"-like shape (more visible in the embodiment of FIG. 3). The side portions 44 thus extend toward the outer cuff member 38 spaced apart from the hand-receiving portion 12, with a circumferential gap 46 being defined between the free end 48 of each side portion 44 and the adjacent end 50 of the outer cuff member 38.

The outer cuff member 38 is hingedly connected to the hand-receiving portion 12 around the opening 34 thereof, opposite of the inner cuff member 36. In a particular embodiment, the inner and outer cuff members 36, 38 are connected to the hand-receiving portion 12 through respective stitch lines. The outer cuff member 38 has a parallelogram-like shape and is progressively wider as it extends away from the hand-receiving portion 12.

The side cuff members 40 extend from the hand-receiving portion 12 and cover the circumferential gaps 46 defined between the inner and outer cuff members 36, 38. The side cuff members 40 therefore partially overlap both the inner cuff member 36 and the outer cuff member 38. The side cuff members 40 each have a straight edge 52 extending over the outer cuff member 38 and a rounded portion 54 extending over the inner cuff member 36. The rounded portion 54 includes a series of eyelets 56 defined therein, and at least one lace 58 extends through the eyelets 56 of both side cuff members and across the inner cuff member 36 such as to interconnect the side cuff members 40.

It is understood that the particular shape of the inner, outer and side cuff members 36, 38, 40 as shown and described therein can be changed for any other appropriate shape depending on the intended use of the glove 10, esthetic consideration, and any other relevant criteria. In addition, the side cuff members 40 can be interconnected by any other adequate type of fastener other than the lace 58, or in some instances can remain unconnected.

In a particular embodiment, the side cuff members 40 are hingedly connected to the hand-receiving portion 12, although it is alternately possible to have the side cuff members 40 rigidly or substantially rigidly connected to the hand-receiving portion 12.

A connection member 60 extends across each circumferential gap 46 to interconnect each side portions 44 of the inner cuff member 36 with the outer cuff member 38. Each connection member 60 is covered and protected by the respective side cuff member 40. As such, when the wearer flexes his/her wrist, the inner cuff member 36 is folded toward the main palm portion 24 by the wrist, and the outer cuff member 38 is "pulled" by the inner cuff member 36 through the connection members 60. As such, both the inner and outer cuff members 36, 38 follow the wrist in its flexing motion, providing protection to the wearer against impact to the inner and outer sides of the wrist, such as for example by a stick, when the wrist is flexed.

In a particular embodiment, the connection members 60 are made of an elastic material. In alternate embodiments, the connection members 60 can be made from a non-elastic material, or be omitted.

In a particular embodiment, the outer and side cuff members 38, 40 are substantially rigid, such as for example by including padding inserts made of rigid thermo-plastics. The inner cuff member 36 is more flexible, and preferably substantially more flexible, than the outer and side cuff members 38, 40, such as to minimize interference of the inner cuff member 36 with the flexing motion of the wrist. For example, the inner cuff member 36 can include flexible padding inserts.

In a particular embodiment, the length of the inner cuff member 36, i.e. the distance between the hand-receiving portion 12 and the free circumferential edge 62 of the inner cuff member 36, is smaller than the length of the outer and side cuff members 38, 40, again to minimize interference of the inner cuff member 36 with the flexing motion of the wrist.

Figure 3:
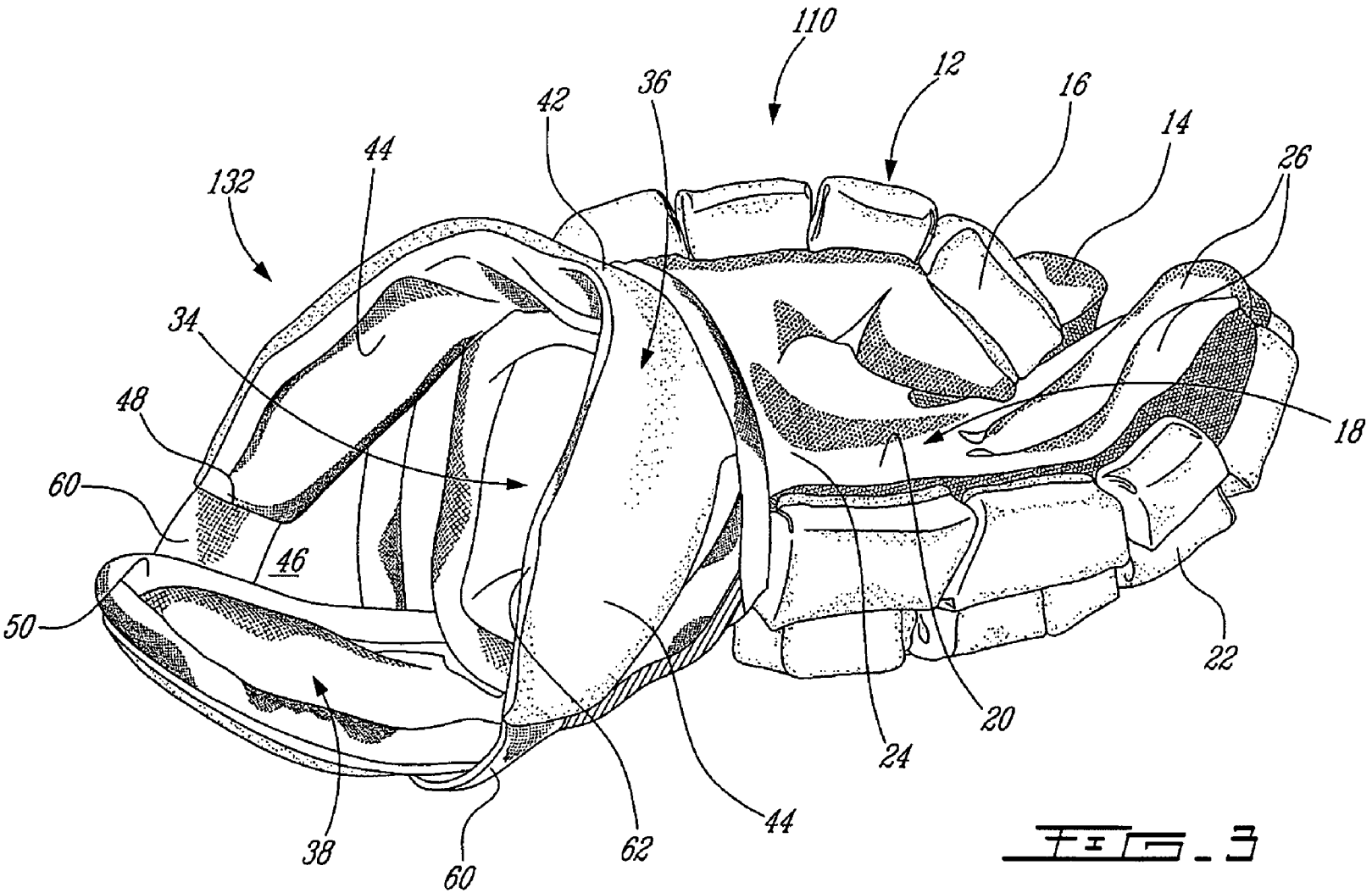
FIG. 3 is a perspective view of the athletic glove of FIG. 1 with side cuff members thereof omitted.

In an alternate embodiment shown in FIG. 3, a glove 110 has a cuff 132 which is composed only of the inner cuff member 36 and outer cuff member 38, i.e. the side cuff members 40 described above are omitted. As the two gloves 10, 110 are similar apart from the omission of the side cuff members 40 in the glove 110, the glove 110 will not be further described herein.

The configuration of the cuff 32, 132 thus allows for a minimal interference of the glove 10, 110 with the flexing motion of the wrist while providing protection to the inner wrist. The presence of the connection members 60 interconnecting the inner cuff member 36 and the outer cuff member 38 allows the outer cuff members 38 to move with the wrist upon flexing thereof such as to provide improved protection to the outer wrist during the flexing motion.

The embodiments of the invention described above are intended to be exemplary. Those skilled in the art will therefore appreciate that the foregoing description is illustrative only, and that various alternate configurations and modifications can be devised without departing from the spirit of the present invention. Accordingly, the present invention is intended to embrace all such alternate configurations, modifications and variances which fall within the scope of the appended claims.

The invention claimed is:

1. An athletic glove comprising a hand-receiving portion and a cuff extending therefrom, the cuff including at least an inner cuff member hingedly connected to the hand-receiving portion along a palm side thereof, an outer cuff member hingedly connected to the hand-receiving portion opposite of the inner cuff member so as to define two opposed circumferential gaps therebetween, at least one connection member extending across each of the circumferential gaps to interconnect the inner and outer cuff members, and two side cuffs members extending from the hand-receiving portion, one of the side cuff members covering each of the circumferential gaps, the side cuffs each being disposed outside of and overlapping a portion of the inner and the outer cuff members.

2. The athletic glove according to claim 1, wherein the connection member is an elastic member.

3. The athletic glove according to claim 1, wherein each of the side cuff members includes a plurality of eyelets defined therethrough along a portion thereof adjacent the inner cuff member, the side cuff members being interconnected by at least one lace passing through the eyelets of both side cuff members and extending at least partially over the inner cuff member.

4. The athletic glove according to claim 1, wherein the inner cuff member includes a central base portion hingedly connected to the hand-receiving portion and side portions extending from each side of the base portion toward the outer cuff member, the side portions being free of any connection with the hand receiving portion, the connection members extending from the side portions.

5. The athletic glove according to claim 1, wherein the inner cuff member is more flexible than the outer cuff member.

6. The athletic glove according to claim 1, wherein the outer cuff member extends further away from the hand-receiving portion than the inner cuff member.

7. An athletic glove comprising a hand-receiving portion for containing a hand of a wearer and a cuff extending from the hand-receiving portion to protect a wrist of the wearer, the cuff including an inner cuff member hingedly connected to the hand-receiving portion along a palm side thereof, an outer cuff member hingedly connected to the hand-receiving portion opposite and spaced apart from the inner cuff member, the outer and inner cuff members being interconnected by connection members such that the outer cuff member is moved toward the wrist when the wrist is flexed against the inner cuff member, two opposed side cuff members extending from the hand-receiving portion and covering the connection members, each of the side cuff members being disposed outwardly from the inner and outer cuff members such as to partially overlapping both the inner and outer cuff members.

8. The athletic glove according to claim 7, wherein the side cuff members are hingedly connected to the hand-receiving portion.

9. The athletic glove according to claim 7, wherein the connection members include elastic members.

10. The athletic glove according to claim 7, wherein the inner cuff member includes a central base portion hingedly connected to the hand-receiving portion and side portions extending from the base portion around the wrist and toward the outer cuff member, the side portions being free of any connection with the hand-receiving portion, and the connection members extending from the side portions.

11. The athletic glove according to claim 7, wherein each of the side cuff members includes a plurality of eyelets defined therethrough in a part thereof adjacent the inner cuff member, the side cuff members being interconnected by at least one lace passing through the eyelets of both side cuff members rand extending at least partially over the inner cuff member.

12. The athletic glove according to claim 7, wherein the inner cuff member is more flexible than the outer and side cuff members.

13. The athletic glove according to claim 7, wherein the outer and side cuff members extend further away from the hand-receiving portion than the inner cuff member such as to minimize interference of the inner cuff member with a flexing motion of the wrist.

14. A method of manufacturing an athletic glove comprising:

providing a hand-receiving portion defining an opening for inserting a hand therein;

hingedly attaching a base portion of an inner cuff member to the hand-receiving portion around the opening thereof and adjacent a palm portion thereof, the inner cuff member including side portions extending from each side of the base portion, and ensuring that the side portions are free of any connection with the hand receiving portion;

hingedly attaching an outer cuff member to the hand-receiving portion around the opening thereof and opposite of the inner cuff member; and interconnecting the side portions of the inner cuff member with adjacent sides of the outer cuff member at a location spaced apart from the hand-receiving portion.

15. The method as defined in claim 14, wherein hingedly attaching the inner cuff member to the hand-receiving portion includes sewing only the base portion of the inner cuff member to the hand-receiving portion.

16. The method as defined in claim 14, wherein interconnecting the inner and outer cuff members includes interconnecting the side portions and the adjacent sides with an elastic member.

17. The method as defined in claim 14, further including attaching at least one side cuff member to the hand-receiving portion around the opening thereof, the side cuff member partially overlapping the inner and outer cuff members.

* * * * *